US010353414B2

(12) United States Patent
Krishnan

(10) Patent No.: US 10,353,414 B2
(45) Date of Patent: Jul. 16, 2019

(54) BANDGAP REFERENCE CIRCUIT WITH INVERTED BANDGAP PAIRS

(71) Applicant: TEXAS INSTRUMENTS INCORPORATED, Dallas, TX (US)

(72) Inventor: Sandeep Shylaja Krishnan, Kozhikode (IN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/856,854

(22) Filed: Dec. 28, 2017

(65) Prior Publication Data

US 2018/0292849 A1 Oct. 11, 2018

(30) Foreign Application Priority Data

Apr. 7, 2017 (IN) ..... 201741012599

(51) Int. Cl.
*G05F 1/46* (2006.01)
*G05F 1/59* (2006.01)
*G05F 3/30* (2006.01)

(52) U.S. Cl.
CPC ..... *G05F 1/468* (2013.01); *G05F 1/46* (2013.01); *G05F 1/59* (2013.01); *G05F 3/30* (2013.01)

(58) Field of Classification Search
CPC ..... G05F 1/46
See application file for complete search history.

(56) References Cited

U.S. PATENT DOCUMENTS

2005/0122091 A1* 6/2005 Marinca ..... G05F 3/30 323/316
2008/0224759 A1* 9/2008 Marinca ..... G05F 3/30 327/539

* cited by examiner

*Primary Examiner* — Jue Zhang
*Assistant Examiner* — Trinh Q Dang
(74) *Attorney, Agent, or Firm* — John R. Pessetto; Charles A. Brill; Frank D. Cimino

(57) ABSTRACT

In some examples, a bandgap reference circuit comprises a first bandgap pair having multiple first diodes and a first resistor positioned between the multiple first diodes. The circuit also comprises a second bandgap pair having multiple second diodes and a second resistor positioned between the multiple second diodes, the second bandgap pair being an inverted form of the first bandgap pair. The circuit further comprises a scaling resistor coupled to the first and second bandgap pairs. The circuit still further comprises an operational amplifier coupled to the first and second bandgap pairs.

17 Claims, 2 Drawing Sheets

BANDGAP REFERENCE CIRCUIT WITH INVERTED BANDGAP PAIRS

CROSS-REFERENCE TO RELATED APPLICATIONS

The present application claims priority to Indian Provisional Patent Application No. 201741012599, which was filed Apr. 7, 2017, is titled "Low Noise And Low Power Bandgap Reference Circuit," and is hereby incorporated herein by reference in its entirety.

BACKGROUND

Bandgap reference voltage supplies are used in various electronic applications. These voltage supplies provide constant reference voltages despite power supply variations, load variations, and temperature changes.

SUMMARY

In some examples, a bandgap reference circuit comprises a first bandgap pair having multiple first diodes and a first resistor positioned between the multiple first diodes. The circuit also comprises a second bandgap pair having multiple second diodes and a second resistor positioned between the multiple second diodes, the second bandgap pair being an inverted form of the first bandgap pair. The circuit further comprises a scaling resistor coupled to the first and second bandgap pairs. The circuit still further comprises an operational amplifier coupled to the first and second bandgap pairs.

In some examples, a bandgap reference circuit comprises first and second bipolar junction transistors (BJTs) and a first resistor arranged in a first bandgap pair. The circuit comprises third and fourth BJTs and a second resistor arranged in a second bandgap pair. The circuit comprises an operational amplifier coupled to the first and second resistors. The circuit comprises a third resistor coupled to the second and fourth BJTs. The first and third BJTs and the first resistor are arranged in a third bandgap pair. The second and fourth BJTs are arranged in a fourth bandgap pair.

In some examples, a bandgap reference circuit comprises a first bipolar junction transistor (BJT) having a first emitter, a first base, and a first collector, the first base shorted to the first collector. The circuit comprises a second BJT coupled to the first BJT via a first resistor, the second BJT having a second emitter, a second base, and a second collector, the second base coupled to the second collector via a second resistor. The circuit comprises a third BJT coupled to the first BJT, the third BJT having a third emitter, a third base, and a third collector, the third base coupled to the third collector via a third resistor. The circuit comprises a fourth BJT coupled to the third BJT via a fourth resistor, the fourth BJT having a fourth emitter, a fourth base, and a fourth collector, the fourth base shorted to the fourth collector. The circuit includes a fifth resistor coupled to the second and fourth collectors and a sixth resistor coupled to the first and third emitters. The circuit comprises an operational amplifier having a first input coupled between the first resistor and the second BJT, a second input coupled between the third BJT and the fourth resistor, and an output coupled to the sixth resistor.

BRIEF DESCRIPTION OF THE DRAWINGS

For a detailed description of various examples, reference will now be made to the accompanying drawings in which.

DETAILED DESCRIPTION

As mentioned above, bandgap reference voltage supplies provide constant, high-precision reference voltages in the face of various fluctuating parameters, including ambient temperature. Nearly all such bandgap reference voltage supplies operate on the principle of offsetting the negative temperature coefficients of their transistors' base-emitter voltages with the positive temperature coefficients of their resistors as current flows through the resistors (commonly known as "proportional to absolute temperature," or PTAT).

Such bandgap reference voltage supplies suffer from multiple sources of flicker noise. Some of the flicker noise arises from bipolar junction transistors (BJTs) in the voltage supplies, but this type of flicker noise is typically addressed by adding a resistor between the base and collector of each BJT. Most of the remainder of the flicker noise arises from the base currents of the input pairs of BJTs (e.g., pnp BJTs) in the voltage supplies' operational amplifiers. These input BJTs generate flicker noise that is typically low frequency. Such low-frequency noise is difficult to eliminate because doing so require prohibitively large filter capacitors, which is not practical in low-power applications, such as mobile phones. Additional resources (e.g., power) can be expended in reducing the noise, but this, again, is impractical in low-power applications. Accordingly, what is needed is a bandgap reference voltage supply capable of reducing flicker noise at low frequencies without expending excessive power.

Described herein are various examples of a bandgap reference circuit that mitigates the disadvantages described above. Examples of the circuit include multiple BJTs, resistors, and an operational amplifier that are configured to include multiple bandgap pairs, with one or more of the bandgap pairs (i.e., a diode and a resistor coupled with another diode) inverted with respect to each other. ("Inverted" bandgap pairs are bandgap pairs that are symmetric opposites of each other, as described in further detail below.) With this particular arrangement of bandgap pairs, resistances that are traditionally found in bandgap voltage supplies can be eliminated, thus reducing the total amount of resistance seen by the inputs of the op amp in the bandgap circuit, thereby reducing the total flicker noise associated with the base currents of the op amp's input BJT pair. Examples of the bandgap reference circuit are now provided with respect to the drawings.

Figure 1:
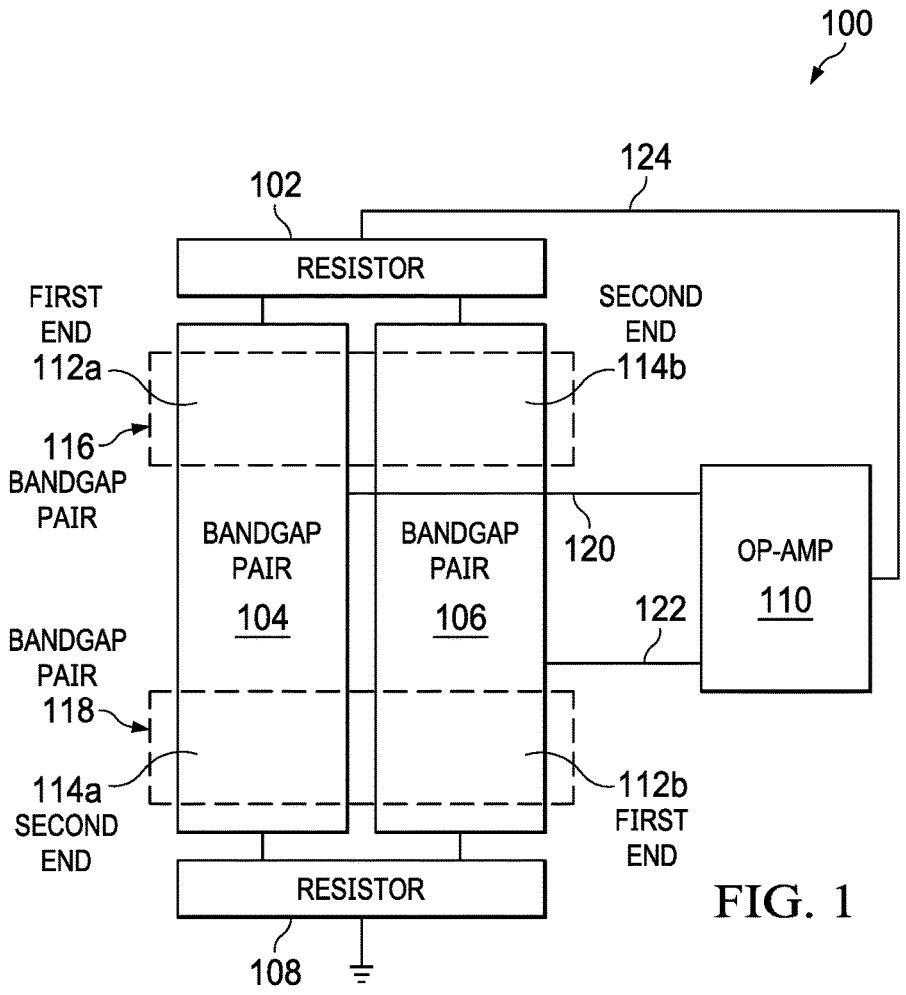
FIG. 1 depicts a block diagram of an illustrative bandgap reference circuit in accordance with various examples.
Figure 2:
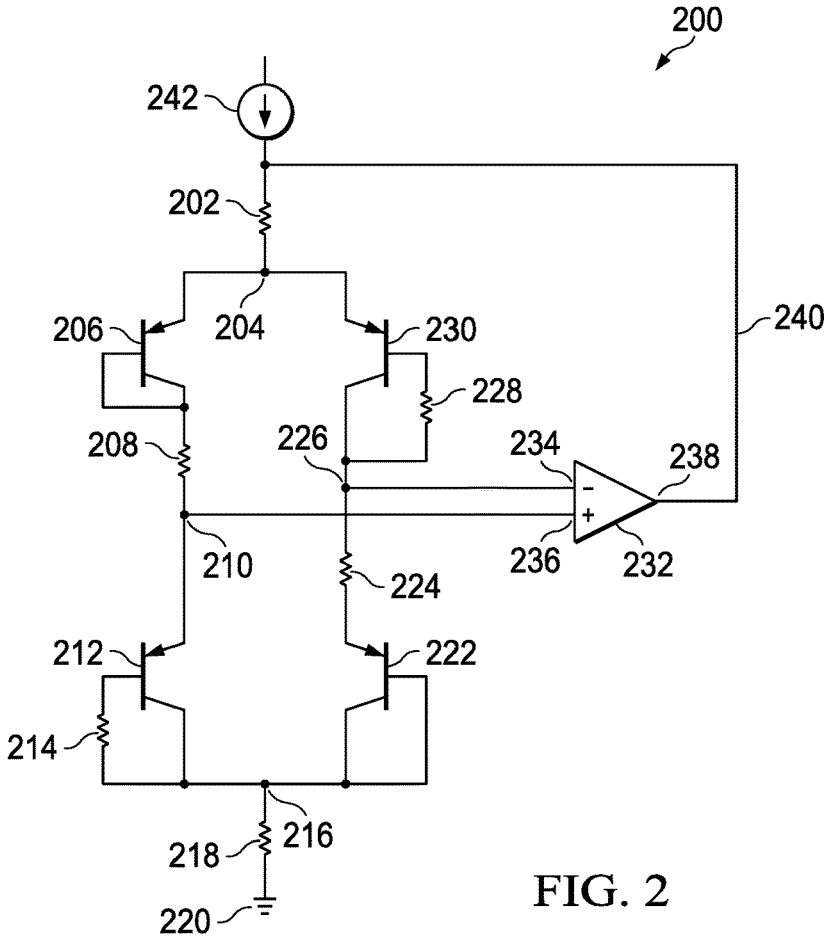
FIG. 2 depicts a circuit schematic diagram of an illustrative bandgap reference circuit in accordance with various examples.

FIG. 1 depicts a block diagram of an illustrative bandgap reference circuit 100 in accordance with various examples. The circuit 100 is a genericized depiction of various bandgap reference circuits that fall within the scope of this disclosure. In some examples, the circuit 100 includes a resistor 102, which couples to a power supply, such as a current source (illustratively depicted in FIG. 2); a bandgap pair 104 coupled to the resistor 102; a bandgap pair 106 coupled to the resistor 102; and a resistor 108 coupled to the bandgap pairs 104 and 106. A "bandgap pair," as used herein, includes two functional components: first, a BJT coupled to a resistor, and second, another BJT, possibly in the form of a diode. Example bandgap pairs are depicted in FIG. 2 and described below. The bandgap pair 106 is an inverted form of the bandgap pair 104, meaning that the two bandgap pairs are symmetric opposites of each other. Hence, the bandgap pair 104 has a first end 112*a* that corresponds to the first end 112*b* of the bandgap pair 106, and the bandgap pair has a second end 114*a* that corresponds to the second end 114*b* of the bandgap pair 106. An example of this "inverted" symmetric relationship is depicted in FIG. 2 and described below.

The bandgap reference circuit 100 further comprises an op amp 110 having a first input 120 that couples to the bandgap pair 104 and another input 122 that couples to the bandgap pair 106. An output 124 of the op amp 110 couples to the resistor 102.

In some examples, the contents of the bandgap pairs 104 and 106 are configured such that they form additional bandgap pairs across the bandgap pairs 104 and 106—i.e., so that they form bandgap pairs 116 and 118. The bandgap pairs 116 and 118, like the bandgap pairs 104 and 106, are inverted with respect to each other, meaning that the circuit components of first end 112*a* correspond to the circuit components of first end 112*b*, and that the circuit components of second end 114*a* correspond to the circuit components of the second end 114*b*. As suggested above, the nature of such symmetric relationships will be more readily understood when described with respect to FIG. 2 below. In FIG. 1, the precise internal configurations of the bandgap pairs 104, 106, 116, and 118 are not described to underscore that the scope of this disclosure is not limited to any specific configuration of circuit components and that any configuration of circuit components that implements the general noise reduction principles described herein are contemplated.

In operation, a current source supplies current through the resistor 102 and through each of the bandgap pairs 104 and 106, through resistor 108, to ground. The op amp 110 uses a negative feedback loop via output 124 to force the currents and voltages in the bandgap pair 104 to equalize with the currents and voltages in the bandgap pair 106 at the nodes at which the inputs 120 and 122 contact the bandgap pairs 104 and 106. The BJTs in the bandgap pairs 104 and 106 are susceptible to base-emitter voltage fluctuations due to temperature but, because resistors with current from the current source are included in the bandgap pairs 104 and 106, and because these resistors with current flowing through them react in an opposite manner to the same temperature fluctuations, the effect of temperature fluctuation is reduced, and the output 124 of the op-amp 110 holds steady. This output 124 is the bandgap reference voltage produced by the bandgap reference circuit 100.

The positive temperature coefficient of the resistor 108 and its current counteract the negative temperature coefficient of the BJTs in the circuit 100, thus combining to produce the reference voltage. By scaling the resistance of the resistor 108, it is possible to adjust the voltage drop across the resistor 108 that counteracts the temperature-dependent voltage drops across the BJTs to produce the reference voltage at the output of the op amp 110. Thus, the resistor 108 is called a "scaling resistor." (The function of the resistor 102 is similar to that of the resistor 108 and thus the resistor 102 is also considered a scaling resistor.) The resistor 108 has a reduced resistance compared to the multiple resistors that would ordinarily be used in lieu of the resistor 108 in traditional bandgap reference voltage supplies. Traditional bandgap reference voltage supplies would use an op amp to try to equalize the voltages across these resistors. Although the principle of operation in such traditional supplies required the presence of such multiple resistors, they also increased the overall resistance seen by the op amp, thus contributing to the low-frequency flicker noise generated by the base currents feeding the input transistor pair in the op amp. Only a single resistor 108, however, is used in the circuit 100 due to the inverted symmetric relationship of the bandgap pairs, as described above. This resistance of the resistor 108 is substantially less than the resistances provided by the multiple resistors in traditional bandgap reference voltage supplies. Accordingly, the resistance seen by the op amp 110 is less than would be seen by op amps in traditional bandgap reference voltage supplies. This reduces the low-frequency flicker noise generated by the op amp 110 and provided on the bandgap reference voltage output 124, because the base current flicker noise of the op amp 110 input transistor pair flows through the equivalent resistance seen by the op amp 110 input terminals, and reducing this resistance reduces the flicker noise seen in the bandgap reference voltage output 124. Further, the architecture of the bandgap reference circuit 100 is such that no additional power is expended beyond that which would be expended in a traditional bandgap reference voltage supply.

FIG. 2 depicts a circuit schematic diagram of an illustrative bandgap reference circuit 200 in accordance with various examples. The bandgap reference circuit 200 is merely one example of the generic bandgap reference circuit 100 and does not limit the range of examples that fall within the scope of the generic bandgap reference circuit 100. The bandgap reference circuit 200 includes a resistor 202 (which is an example of the resistor 102 in FIG. 1) and a BJT 206 (which, in some examples, is part of the bandgap pair 104 and the bandgap pair 116 in FIG. 1) coupled to the resistor 202 via a node 204. The BJT 206 has its base tied to its collector, which causes the BJT 206 to behave as a diode. The collector of the BJT 206 couples to a resistor 208 (which, in examples, is part of the bandgap pair 104 and the bandgap pair 116 in FIG. 1). The bandgap reference circuit 200 also comprises a BJT 212 with its base coupled to its collector via a resistor 214. The resistor 214 reduces the flicker noise associated with the base current of the BJT 212, which is necessary in some examples because the size of the BJT 212 relative to the BJT 206 is small and thus the flicker noise is more substantial. Because the base is tied to the collector, the BJT 212 acts as a diode. The collector of the BJT 212 couples to node 216. Together, the BJT 212 (with its base resistor 214) forms a bandgap pair with the BJT 206 and the resistor 208. For example, these components correspond to the bandgap pair 104 in FIG. 1.

A scaling resistor 218 couples to node 216 and to ground 220. In some examples, this scaling resistor 218 corresponds to the resistor 108 of FIG. 1. The node 216 couples to the collector of a BJT 222, which has a base shorted to the collector. The emitter of the BJT 222 couples to a resistor 224. In turn, the resistor 224 couples to the collector of a BJT 230. The base and collector of the BJT 230 are coupled via a resistor 228. The emitter of the BJT 230 couples to the node 204.

Because their respective bases and collectors are coupled, the BJTs 222 and 230 act as diodes. The BJT 230 has the base resistor 228 to attenuate its base current flicker noise, which in some examples is more substantial than that of the BJTs 222 and 206 because it is sized smaller than those BJTs. In some examples, the sizing ratio (i.e., the ratio of transistor W/L sizes) of the BJTs 206 and 230 is 24:1. In some examples, the sizing ratio of the BJTs 222 and 212 is 24:1. Other sizing ratios can be used.

The BJT 230 (with its base resistor 228) forms a bandgap pair with the resistor 224 and the BJT 222. In some examples, this bandgap pair corresponds to the bandgap pair 106 of FIG. 1. Similarly, the BJT 206, the resistor 208, and the BJT 230 form a bandgap pair, such as the bandgap pair 116 of FIG. 1. The BJT 212, the resistor 224, and the BJT 222 form a bandgap pair, such as the bandgap pair 118 of FIG. 1. An op amp 232 has an inverting input 234 that couples to node 226 and a non-inverting input 236 that couples to node 210. An output 238 of the op amp 232 couples to the resistor 202 and current source 242 via feedback loop 240. The resistor 202 has an operation that is similar to that of the scaling resistor 218. Thus, the resistor 202 is also considered to be a scaling resistor. Because both resistors 202 and 218 contribute to the resistance seen by the op amp 232 in similar ways, they can be considered to be two parts of a single scaling resistance. In some examples, the resistor 202 is omitted and the resistance of resistor 218 is increased to compensate for the absence of the resistor 202, and vice versa.

The bandgap pair formed by BJTs 206, 212 (including base resistor 214) and the resistor 208 is inverted compared to the bandgap pair formed by BJTs 222, 230 (including base resistor 228) and resistor 224. This means that the two bandgap pairs are symmetric opposites. Stated another way, just as a shorted BJT 206 and resistor 208 are positioned at the top end of the bandgap pair on the left, a shorted BJT 222 and resistor 224 are positioned on the bottom end of the bandgap pair on the right (described above as the first ends 112*a* and 112*b* in FIG. 1). Similarly, just as a BJT 212 with a base resistor 214 is positioned at the bottom end of the bandgap pair on the left, a BJT 230 with a base resistor 228 is positioned at the top end of the bandgap pair on the right (described above as the second ends 114*a*, 114*b* in FIG. 1). The grouping of the resistor 208 with the BJT 206 instead of the BJT 212 is because the input 236 of op amp 232 couples to node 212 in between the resistor 208 and the BJT 212. Similarly, the grouping of the resistor 224 is with the BJT 222 instead of the BJT 230 because the input 234 of op amp 232 couples to node 226 in between the resistor 224 and the BJT 230.

In some examples, the bandgap pair formed by the BJT 206, resistor 208, and BJT 230 is inverted with respect to the bandgap pair formed by the BJT 222, the resistor 224, and the BJT 212. This is because in the bandgap pair on the top (e.g., corresponding to bandgap pair 116 in FIG. 1), a BJT with resistor is on the left while the lone BJT (with only a base resistor) is on the right, and conversely, in the bottom bandgap pair (e.g., corresponding to bandgap pair 118 in FIG. 1), a BJT with resistor is on the right while the lone BJT (with only a base resistor) is on the left. In some examples, some or all BJTs depicted in FIG. 2 are pnp BJTs, although npn BJTs also are contemplated and can be used.

In operation, the current from the current source 242 flows through resistor 202 and divides evenly between the two vertical bandgap pairs, eventually flowing through the resistor 218 to ground 220. The op amp 232 uses the negative feedback loop 240 to control current flow through the two vertical bandgap pairs such that the voltages at nodes 210, 226 are equal. The positive and negative temperature coefficient components in the bandgap pairs offset each other, as described above, resulting in a constant, temperature-independent bandgap reference voltage provided at output 238 of the op amp 232.

As mentioned above, due to the inverted nature of the vertical and horizontal bandgap pairs in FIG. 2 (i.e., those corresponding to bandgap pairs 104, 106, 116, and 118 in FIG. 1), the resistance of the resistors 202, 208, 224, and 218 is reduced relative to the resistance that would otherwise be necessary in traditional bandgap reference voltage supplies. Because the resistance of the scaling resistors 202 and 218 is reduced, the overall resistance seen by the op amp is reduced, and so the base current flicker noise that disturbs the reference voltage produced by the op amp 232 is reduced.

The BJTs, resistors, and other components of the bandgap reference circuit 200 can be rearranged or otherwise modified as desired within the bounds of the generic bandgap reference circuit 100 to achieve the same or similar functionality and low-frequency noise reduction benefits as those described herein. All such variations are contemplated and fall within the scope of this disclosure.

Figure 3:
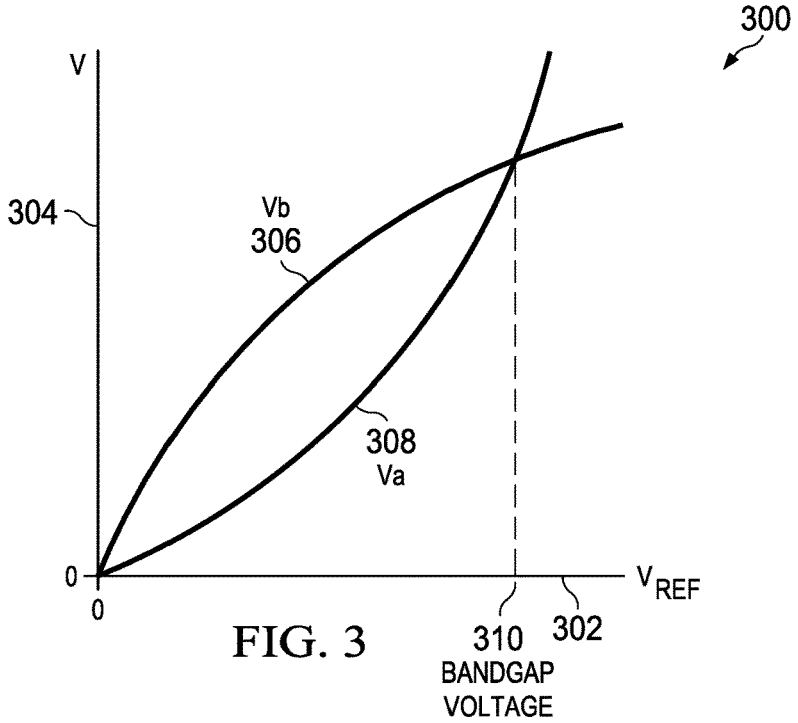
FIG. 3 depicts an illustrative load line graph related to the circuit schematic diagram of FIG. 2, in accordance with various examples.

FIG. 3 depicts an illustrative load line graph 300 related to the circuit schematic diagrams of FIGS. 1 and 2, in accordance with various examples. The graph 300 includes the reference voltage produced by op amp 232 on the x-axis 302 and the voltages at op amp inputs 234, 236 on the y-axis 304. In particular, curves 306 and 308 plot the voltages at the inputs 234, 236 for various values of the reference voltage produced by the op amp 232. The curves 306, 308 intersect at a point that marks the equilibrium achieved by the op amp 232 as it attempts to equalize the voltages at the nodes 210, 226 using the negative feedback loop 240. Because the op amp 232 maintains operation of the bandgap reference circuit 200 at the intersection point between the curves 306 and 308, the reference voltage 310 corresponding to this intersection point marks the constant reference voltage that will be provided by the reference circuit 200.

In the foregoing discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection or through an indirect connection via other devices and connections.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. A bandgap reference circuit comprising:

a first bandgap pair having multiple first diodes and a first resistor positioned between the multiple first diodes;

a second bandgap pair having multiple second diodes and a second resistor positioned between the multiple second diodes, the second bandgap pair being an inverted form of the first bandgap pair;

a scaling resistor coupled to the first and second bandgap pairs; and an operational amplifier coupled to the first and second bandgap pairs;

wherein the multiple first diodes include a first bipolar junction transistor (BJT) having a first base and a first collector shorted together; and wherein the multiple first diodes include a second BJT having a second base and a second collector coupled via a resistor.

2. The circuit of claim 1, wherein a first input of the operational amplifier couples to a node between the second BJT and the first resistor.

3. The circuit of claim 2, wherein a sizing ratio between the first BJT and a third BJT in the second bandgap pair is the same as another sizing ratio between the second BJT and a fourth BJT in the second bandgap pair, a second input of the operational amplifier coupled to another node positioned between the third BJT and the second resistor.

4. The circuit of claim 3, wherein the scaling resistor couples to the second collector and to a collector of the fourth BJT via a common node.

5. The circuit of claim 3, wherein the third BJT has its base and collector coupled via another resistor.

6. The circuit of claim 3, wherein the fourth BJT has its base and collector shorted together.

7. A bandgap reference circuit comprising:

a first bandgap pair having multiple first diodes and a first resistor positioned between the multiple first diodes;

a second bandgap pair having multiple second diodes and a second resistor positioned between the multiple second diodes, the second bandgap pair being an inverted form of the first bandgap pair;

a scaling resistor coupled to the first and second bandgap pairs; and an operational amplifier coupled to the first and second bandgap pairs;

wherein the multiple first diodes include a first bipolar junction transistor (BJT) having a first base and a first collector shorted together; and further comprising a third resistor coupled to an emitter of the first BJT and to an emitter of another BJT in the multiple second diodes.

8. A bandgap reference circuit comprising:

first and second bipolar junction transistors (BJTs) and a first resistor arranged in a first bandgap pair;

third and fourth BJTs and a second resistor arranged in a second bandgap pair;

an operational amplifier coupled to the first and second resistors; and a third resistor coupled to the second and fourth BJTs, wherein the first and third BJTs and the first resistor are arranged in a third bandgap pair, and wherein the second and fourth BJTs are arranged in a fourth bandgap pair.

9. The circuit of claim 8, wherein a base and emitter of the first BJT are shorted together.

10. The circuit of claim 8, wherein a base and emitter of the second BJT are coupled via a fourth resistor.

11. The circuit of claim 8, wherein a base and emitter of the third BJT are coupled via a fourth resistor.

12. The circuit of claim 8, wherein a base and emitter of the fourth BJT are shorted together.

13. The circuit of claim 8, wherein the third resistor couples to ground.

14. The circuit of claim 8, further comprising a fourth resistor coupled to the first and third BJTs and to an output of the operational amplifier.

15. A bandgap reference circuit comprising:

a first bipolar junction transistor (BJT) having a first emitter, a first base, and a first collector, the first base shorted to the first collector;

a second BJT coupled to the first BJT via a first resistor, the second BJT having a second emitter, a second base, and a second collector, the second base coupled to the second collector via a second resistor;

a third BJT coupled to the first BJT, the third BJT having a third emitter, a third base, and a third collector, the third base coupled to the third collector via a third resistor;

a fourth BJT coupled to the third BJT via a fourth resistor, the fourth BJT having a fourth emitter, a fourth base, and a fourth collector, the fourth base shorted to the fourth collector;

a fifth resistor coupled to the second and fourth collectors;

a sixth resistor coupled to the first and third emitters; and an operational amplifier having a first input coupled between the first resistor and the second BJT, a second input coupled between the third BJT and the fourth resistor, and an output coupled to the sixth resistor.

16. The circuit of claim 15, wherein the first input is a non-inverting input and the second input is an inverting input.

17. The circuit of claim 15, wherein the fifth resistor couples to ground.

* * * * *